US006036556A

United States Patent [19]

Baker et al.

[11] Patent Number: 6,036,556

[45] **Date of Patent: *Mar. 14, 2000**

[54] OUTBOARD MOTOR WITH BLEED FOR ENGINE COOLING JACKET

[75] Inventors: Jeffrey Lowell Baker, Palm City; Michael Grant Vogt, Port St. Lucie; Arthur Grey Manchester, Stuart, all of Fla.; William Scott Craig, Kenosha, Wis.; Duane Edward Rogers, Calhoun, Ga.; Charles B. Hall, Ingleside, Ill.

[73] Assignee: Outboard Marine Corporation, Waukegan, Ill.

[ * ] Notice: This patent is subject to a terminal disclaimer.

[21] Appl. No.: 09/023,180

[22] Filed: Feb. 13, 1998

Related U.S. Application Data

[63] Continuation of application No. 08/728,602, Oct. 10, 1996, Pat. No. 5,752,863.

[51] Int. Cl.[7] ..... B63H 11/00

[52] U.S. Cl. ..... 440/38; 440/88

[58] Field of Search ..... 440/88, 39, 38, 440/46, 40, 41, 42, 43; 114/151

[56] References Cited

U.S. PATENT DOCUMENTS

| | | | |
|---|---|---|---|
| 2,466,525 | 4/1949 | Wilson . | |
| 3,035,409 | 5/1962 | Pifer | 440/41 |
| 3,233,573 | 2/1966 | Hamilton . | |
| 3,249,083 | 5/1966 | Irgene . | |
| 3,867,105 | 2/1975 | Wagner | 23/288 F |
| 4,258,642 | 3/1981 | Burmeister . | |
| 4,423,696 | 1/1984 | Aker . | |
| 4,437,841 | 3/1984 | Stallman . | |
| 4,636,175 | 1/1987 | Frazzell et al. . | |
| 4,699,597 | 10/1987 | Oja . | |
| 4,752,257 | 6/1988 | Karls et al. . | |
| 4,767,366 | 8/1988 | Lang . | |
| 4,787,328 | 11/1988 | Inoue . | |
| 4,832,639 | 5/1989 | Karls et al. . | |
| 4,832,640 | 5/1989 | Karls . | |
| 4,861,293 | 8/1989 | McGowan et al. . | |
| 4,954,109 | 9/1990 | McMorris . | |
| 5,096,446 | 3/1992 | Tazaki et al. . | |
| 5,098,322 | 3/1992 | Higby . | |
| 5,215,487 | 6/1993 | Gruber . | |
| 5,366,397 | 11/1994 | Suganuma et al. . | |
| 5,472,359 | 12/1995 | Allbright, Jr. | 440/38 |

FOREIGN PATENT DOCUMENTS

| | | |
|---|---|---|
| 664183 | 6/1963 | Canada . |

*Primary Examiner*—Sherman Basinger
*Attorney, Agent, or Firm*—John H. Pilarski; Dennis M. Flaherty

[57] ABSTRACT

Disclosed herein is a jet propulsion unit comprising a housing including a wall defining a water tunnel having therein a water outlet port, and a recess located in the wall defining the tunnel and in surrounding relation to the port, and a screen located in the recess and extending across the port and in flush relation to the wall defining the tunnel.

8 Claims, 2 Drawing Sheets

OUTBOARD MOTOR WITH BLEED FOR ENGINE COOLING JACKET

RELATED PATENT APPLICATION

This application is a continuation application of U.S. patent application Ser. No. 08/728,602 filed on Oct. 10, 1996, and issued on May 19, 1998 as U.S. Pat. No. 5,752, 863.

BACKGROUND OF THE INVENTION

The invention relates generally to jet propulsion units, and, more particularly, to jet propulsion units which form part of an outboard motor. Still more particularly, the invention relates to draining water from the water passage or tunnel of the jet propulsion unit for the purpose of cooling the marine engine driving the impeller in the jet propulsion unit. In addition, the invention relates to filtering such water to be used for cooling the marine engine so as to remove debris from the cooling water.

Outboard motors including jet propulsion units are not new. Such prior jet propulsion units also included water passages or tunnels including water outlet ports for draining water from the water passage, as well as a conduit connecting the port to the marine engine for conducting water from the port to the cooling jacket of the marine engine. Such conduits have included "in line" water strainers (which were located downstream of the port) for the purpose of straining or filtering the cooling water to prevent passage of undesirable debris into the water jacket of the marine engine. Such "in-line" strainers undesirably and frequently required cleaning to insure continued water flow therethrough. In these past installations, water was sucked through the filter or strainer by a remote pump. This vacuum or sucking action is not self-cleaning at very low speeds or at idle, and, in fact, these systems can be self-clogging. Plastic bags, seaweed, leaves, and such can adhere to the previous "in-line" screens, thereby reducing or preventing water supply to the engine cooling jacket.

Attention is directed to the following U.S. patents:

U.S. Pat. No. 2,466,525, Wilson, issued Apr. 5, 1949

U.S. Pat. No. 3,233,573, Hamilton, issued Feb. 8, 1966

U.S. Pat. No. 3,249,083, Irgens, issued May 3, 1966

U.S. Pat. No. 4,258,642, Burmeister, issued Mar. 31, 1981

U.S. Pat. No. 4,423,696, Aker, issued Jan. 3, 1984

U.S. Pat. No. 4,437,841, Stallman, issued Mar. 20, 1984

U.S. Pat. No. 4,787,328, Inoue, issued Nov. 29, 1988

U.S. Pat. No. 4,636,175, Frazzell et al., issued Jan. 13, 1987

U.S. Pat. No. 4,699,597, Oja, issued Oct. 13, 1987

U.S. Pat. No. 4,752,257, Karls et al. issued Jun. 21, 1988

U.S. Pat. No. 4,767,366, Lang, issued Aug. 30, 1988

U.S. Pat. No. 4,832,639, Karls et al., issued May 23, 1989

U.S. Pat. No. 4,832,640, Karls, issued May 23, 1989

U.S. Pat. No. 4,861,293, McGowan et al., issued Aug. 29, 1989

U.S. Pat. No. 4,954,109, McMorries, IV, issued Sep. 4, 1990

U.S. Pat. No. 5,096,446, Tazaki et al., issued Mar. 17, 1992

U.S. Pat. No. 5,098,322, Higby, issued Mar. 24, 1992

U.S. Pat. No. 5,215,487, Gruber, issued Jun. 1, 1993

U.S. Pat. No. 5,366,397, Suganuma et al., issued Nov. 22, 1994

Attention is also directed to the following foreign patent:

Canadian Patent No. 664,183, Johnson et al.

SUMMARY OF THE INVENTION

The invention provides a jet propulsion unit comprising a housing including a wall defining a water tunnel having therein a water outlet port, and a recess located in the wall defining the tunnel and in surrounding relation to the port, and a screen located in the recess and extending across the port.

The invention also provides a jet propulsion unit comprising a housing including a planar surface, a water tunnel which passes through the planar surface and which includes a portion having a water outlet port spaced from the planar surface, and a recess located in surrounding relation to the water outlet port, and an internal conduit communicating with the water outlet port and extending to the planar surface, an impeller rotatably mounted in the tunnel adjacent to or forwardly of the recess, a stator housing surrounding the impeller, a screen located in the recess and extending across the water outlet port and in generally flush relation to the wall defining the tunnel, and a backing member located in the recess downstream of the screen and extending across the water outlet port.

The invention also provides an outboard motor comprising a propulsion unit including a power head including an internal combustion engine having a coolant jacket, and a lower unit including a drive shaft housing fixed to the powerhead, and a jet drive comprising a housing including a wall defining a water tunnel, a water outlet port located in the wall defining the tunnel, and a recess located in the wall defining the tunnel and in surrounding relation to the port, a conduit communicating with the water outlet port and extending forwardly and internally in the housing, an impeller rotatably mounted in the tunnel adjacent to or forwardly of the recess, a stator housing located around the impeller, a screen located in the recess and extending across the water outlet port and in generally flush relation to the wall defining the tunnel, and an apertured backing member located in the recess downstream of the screen and extending across the water outlet port.

Other features and advantages of the invention will become apparent to those skilled in the art upon review of the following detailed description, claims and drawings.

Figure 1:
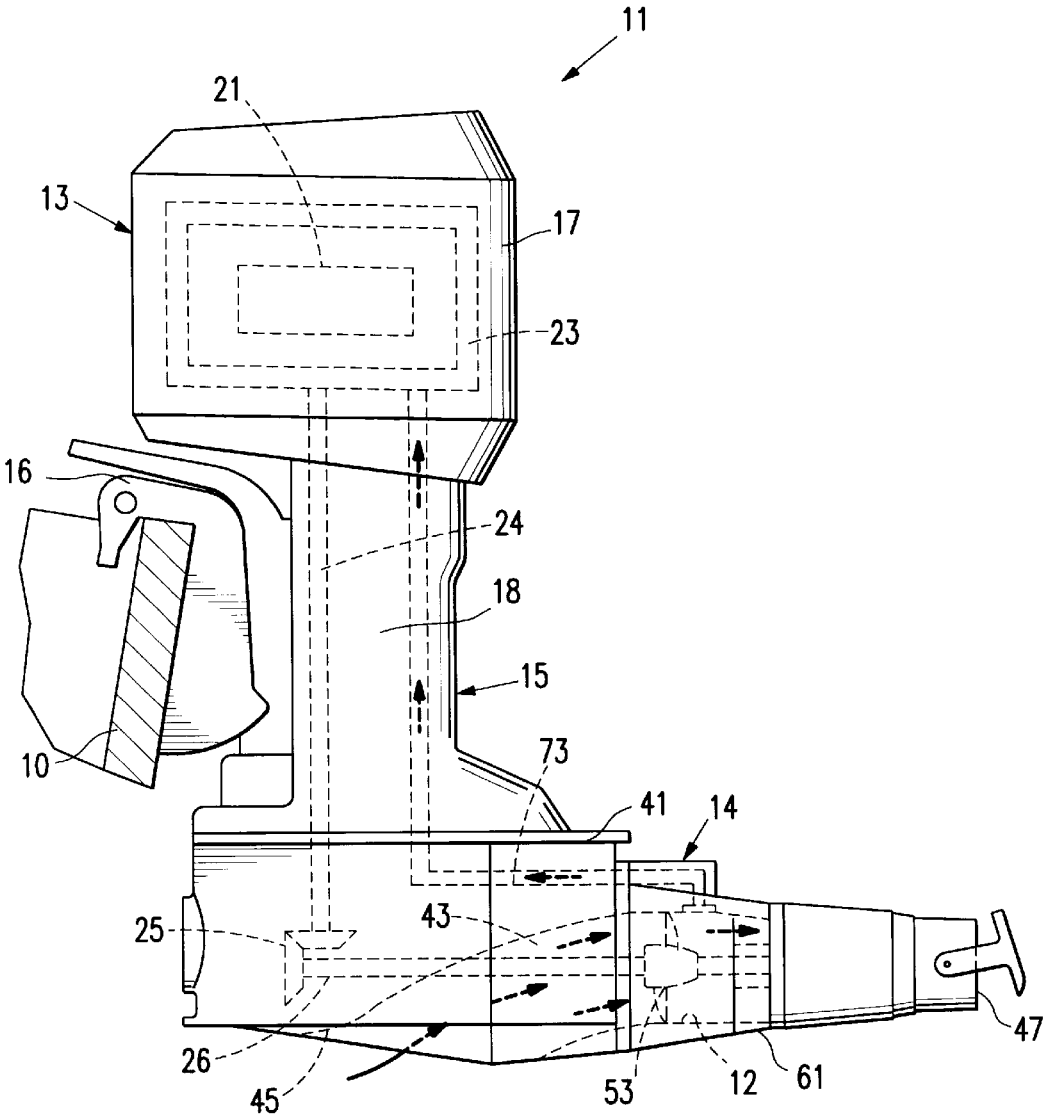
FIG. 1 is a side elevational view of an outboard motor including a jet drive or propulsion unit which embodies various of the features of the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is understood that the phraseology and terminology used herein is for the purpose of description and should not be regarded as limiting.

DESCRIPTION OF THE PREFERRED EMBODIMENT

Shown in the drawings is a marine propulsion device in the form of an outboard motor 11 including a power head 13, a lower unit 15 rigidly connected to the power head and a jet propulsion unit 14. The outboard motor 11 also includes bracket structure 16 (not specifically shown—but well known) for attaching the propulsion unit to a boat transom 10 to enable tilting and steering of the propulsion unit relative to the boat.

The power head 13 comprises an internal combustion engine 21 including a water cooling jacket 23 mounted in an upper housing 17. The lower unit 15 is comprised of a middle housing 18 enclosing a drive shaft 24. The drive shaft extends to a gear set 25 which is connected to a second drive shaft 26. While the jet propulsion unit 14 disclosed herein forms a part of the outboard motor 11, the invention is equally applicable to stern drive units including jet drives or jet propulsion units, to inboard marine installations including jet drives or jet propulsion units, and to personal water craft employing jet drives or jet propulsion units.

The jet drive or jet propulsion unit 14 disclosed herein includes a lower housing 41 having an interior wall 43 which defines a generally tubular water tunnel or passage, a forwardly located inlet 45 and a rearwardly located discharge or outlet 47. Located in the water tunnel or passage are stator vanes 51, and a rotatably mounted impeller 53 which is driven by the engine 21 through a conventional drive train including the shafts 24 and 26 and the gear set 25. Around the impeller is a stator housing 12.

The lower housing 41 can be a one-piece member or can be fabricated as an assembly of several members. In the specifically disclosed construction, the housing is an assembly and comprises a first housing member 61 including a first wall 63 through which the water tunnel passes, which water tunnel is circular in cross section and which includes a wall top portion 64. Located in the top wall portion is a water outlet hole, opening, or port 71 which communicates with a conduit or passage 73 extending forwardly and internally of the housing member 61 to the forward wall 63. The forward wall 63 abuts a planar surface 75 which constitutes one end of a second housing member 76 and through which passes the water passage or tunnel wall 43 and the conduit 73. The conduit 73 also passes through the middle housing 18 and into the upper housing 17 so as to connect to the water jacket 23.

Located in the housing member 61 and in the top portion 64 is a recess 81 which surrounds the water outlet port 71.

Figure 2:
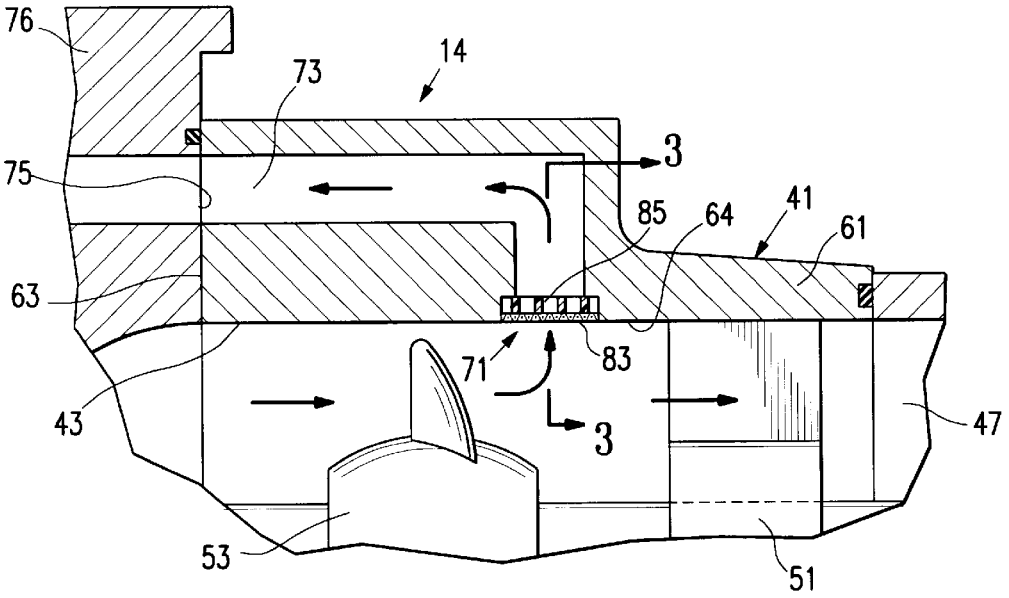
FIG. 2 is an enlarged view, in partial section, of a portion of the outboard motor shown in FIG. 1.
Figure 3:
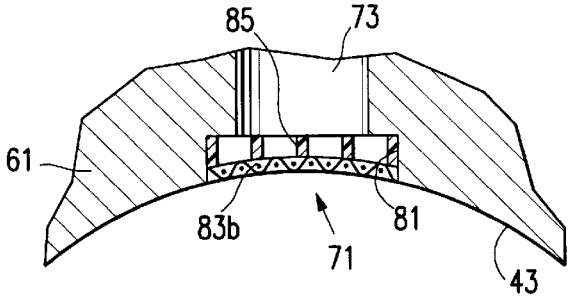
FIG. 3 is a fragmentary sectional view taken along line 3—3 of FIG. 2, but illustrating a concave screen.
Figure 5:
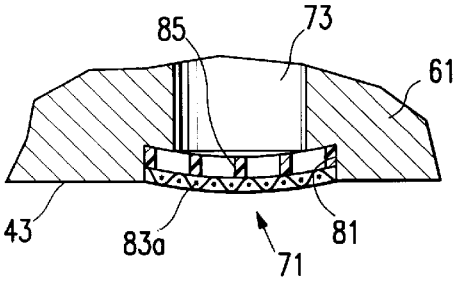
FIG. 5 is a fragmentary sectional view taken along line 5—5 of FIG. 4.
Figure 4:
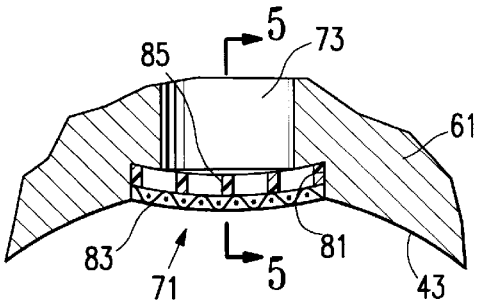
FIG. 4 is a view similar to FIG. 3 and illustrates another embodiment of an outboard motor embodying various of the features of the invention.

Located in the recess 81 is a screen or filter 83 which is preferably removably connected to the first housing member 61, as for instance, by screws (not shown). The screen extends across the water outlet port 71 and at the periphery thereof, is in a generally flush relationship to the wall 43 defining the water tunnel. The screen 83*a* is (as shown in FIGS. 4 and 5) preferably slightly convex in shape, but can be flat (FIG. 2), or can be concave (as the screen 83*b* is shown in FIG. 3) to completely conform to the shape of the water tunnel wall 43. The screen or filter 83 is preferably fabricated from a non-corroding material, such as brass or stainless steel, and, preferably, has a mesh of about 15 openings per inch by 15 openings per inch so as to exclude from the water outlet port 71 (and hence, from the engine cooling jacket 23) debris (such as shells, rocks, weeds, twigs, leaves, and such) which are of larger size than the mesh and which could clog thermostats, elbows, tees, and, in general, water passages, thereby causing engine overheating. Of course, other larger or smaller size meshes can also be employed.

Located in the recess 81 below or underneath or downstream of the screen 83 (or 83*a* or 83*b*) is a backing member 85 which preferably is fabricated of ribbed plastic, which supports and strengthens the screen 83, and which also extends across the conduit 73 and the water outlet port 71, thereby assisting in retaining the shape of the screen 83, and which is apertured to permit water flow therethrough. The backing member may or may not be included depending upon the rigidity of the screen material. Thus, if the screen is sufficiently rigid, the backing member can be omitted. In addition, the backing member can be attached to the screen or the backing member can be a separate piece.

In operation, rotation of the impeller 53 forces water flow rearwardly through the water tunnel and past and over the screen 83. Such passage results in water flow through the outlet port 71, without passage through the screen of undesirable debris. At the same time, the rearwardly flowing water cleanses or flushes the screen of any debris which may "hang-up" thereon. In effect, water is pushed over and through the screen. Because of the rearwardly flowing water, debris is flushed over the screen instead of adhering or collecting thereon. As engine speed increases, rearward water flow increases, thereby increasing the cleansing effect. Accordingly, the screen prevents engine overheating due to loss of water pressure or reduced water volume for cooling.

Use of the disclosed screen with the jet drive 14 permits elimination of the previously employed "in-line" strainers because the particulate matter which does pass through the screen is sufficiently small so that the engine cooling system is not adversely affected. In addition, in jet drives, the impeller 53 rotates even during neutral drive condition and when the engine 21 is operating at idle speed. Thus, water pressure is always present at the screen, regardless of engine speed, to effect both water flow through the screen and cleansing of the screen due to water flow thereover and past.

The engine cooling water outlet port and screen assembly could be located anywhere within the tunnel wall where sufficient water pressure is present, i.e., anywhere in the region of, or aft of, the impeller. Such location includes, without limitation, location of a water outlet port and screen assembly adjacent to the stator walls, or adjacent to any vane, or adjacent to the hub, or adjacent to a fixed nozzle, or adjacent to a steering nozzle, or adjacent to any other extensions of the tunnel and/or pump system.

Thus, the outlet port and screen assembly can be located in any location around the circumference of the tunnel wall, and adjacent to, or aft of, the impeller, or in any location forward of the last water exit or outlet port located at the furthest aft point.

More specifically, the water outlet port and screen assembly need not be limited to a location at the top or bottom of the tunnel wall. The only limitation on the location of the water outlet port and screen assembly is to avoid areas of minimal water pressure, which minimal water pressure is not present in areas mentioned above.

When more than one impeller, propeller, or screw is employed the water outlet port and screen assembly can be located in front of, forward of, or ahead of, one of the impellers or the like, but adjacent to, or behind, or aft of, another of the impellers or the like.

Multiple outlet ports and screens (for engine cooling water) can be located in close proximity to the impeller, or in separate sections of the water tunnel aft of the impeller. For example, one outlet port and screen can be located in the stator vanes area and another outlet port and screen can be located in the fixed nozzle, both outlet ports and screens functioning to afford flow to the engine cooling jacket, even though the outlet ports are subject to different water pressures, with both outlet ports and screens functioning at the same time, even though the outlet ports and screens are subject to different psi at different speeds.

Various of the features of the invention are set forth in the following claims.

We claim:

1. An outboard motor having a jet propulsion unit comprising in combination:

a housing forming a water tunnel and having an upstream inlet and a downstream outlet, said inlet being in communication with ambient water from about a boat to which the outboard motor is mounted, said water tunnel having an inner surface which guides said ambient water passing from said inlet to said outlet;

an impeller rotatably mounted within said tunnel between said inlet and said outlet, rotation of said impeller forcing said ambient water through said tunnel;

an engine connected to said housing, said engine having a water cooling jacket;

drive elements connected to said engine and said impeller for transmitting rotational motion from said engine to said impeller;

a conduit extending from said inner surface of said water tunnel to said water cooling jacket for passing ambient water from said tunnel to said water jacket, said conduit terminating in a port which is in flow communication with said water tunnel at a location adjacent to or downstream of said impeller and upstream of said outlet where said ambient water is at an elevated pressure;

a screen overlying said port to prevent debris from entering said conduit, wherein said screen is in generally flush relationship with said inner surface of said water tunnel such that ambient water flowing through said water tunnel without entering said port washes across the face of said screen to remove any solid material therefrom.

2. The apparatus as recited in claim 1, further comprising a recess located in surrounding relation to said port, wherein said screen is installed in said recess.

3. The apparatus as recited in claim 2, further comprising an apertured backing member arranged in said recess between said screen and said port.

4. The apparatus as recited in claim 1, further comprising an apertured backing member arranged adjacent to said screen.

5. A pump jet apparatus for a marine engine, comprising:

a housing forming a water tunnel having an inlet, an outlet and an inner surface which guides water flowing from said inlet to said outlet;

an impeller rotatably mounted within said tunnel between said inlet and said outlet, rotation of said impeller causing water to flow through said water tunnel in the direction from said inlet to said outlet;

a port which is in flow communication with said water tunnel at a location adjacent to or downstream of said impeller and upstream of said outlet;

a screen overlying said port and in generally flush relationship with said inner surface of said water tunnel such that water impelled by said impeller toward said outlet flows across the face of said screen; and a recess located between said port and said water tunnel, wherein said screen is installed in said recess.

6. The pump jet apparatus as recited in claim 5, further comprising an apertured backing member arranged in said recess between said screen and said port.

7. An apparatus for propelling a watercraft, comprising:

a powerhead comprising a motor cooled by water cooling jacket;

a housing forming a water tunnel having an inlet, an outlet and an inner surface which guides water flowing from said inlet to said outlet;

an impeller rotatably mounted within said tunnel between said inlet and said outlet, rotation of said impeller causing water to flow through said water tunnel in the direction from said inlet to said outlet;

a drive train for coupling said impeller to said motor;

a port which is in flow communication with said water tunnel at a location adjacent to or downstream of said impeller and upstream of said outlet;

a conduit connecting said port to said water cooling jacket;

a screen for blocking debris in said water tunnel from entering said port, said screen being in generally flush relationship with said inner surface of said water tunnel such that water impelled by said impeller toward said outlet flows across the face of said screen to remove any blocked debris therefrom, and a recess located between said port and said water tunnel, wherein said screen is installed in said recess.

8. The apparatus as recited in claim 7, further comprising an apertured backing member arranged in said recess between said screen and said port.

* * * * *